United States Patent [19]

Thomas

[11] Patent Number: 4,463,670

[45] Date of Patent: Aug. 7, 1984

[54] CAN CRUSHER

[76] Inventor: Robert C. Thomas, 1135 Princeton Dr., Richardson, Tex. 75081

[21] Appl. No.: 439,362

[22] Filed: Nov. 5, 1982

[51] Int. Cl.[3] ..... B30B 9/32

[52] U.S. Cl. ..... 100/45; 100/53; 100/218; 100/289; 100/902

[58] Field of Search ..... 100/902, 49, 289, 218, 100/256, 45, 53

[56] References Cited

U.S. PATENT DOCUMENTS

| | | | |
|---|---|---|---|
| 1,040,396 | 10/1912 | Paal | 100/218 |
| 1,675,669 | 7/1928 | Snyder | 100/218 |
| 3,580,167 | 5/1971 | Simshauser | 100/52 |
| 3,916,780 | 11/1975 | Heiser | 100/49 |
| 3,960,070 | 6/1976 | McClure et al. | 100/49 |
| 3,976,002 | 8/1976 | Gerlach | 100/215 |
| 4,018,147 | 4/1977 | Marcade et al. | 100/45 |
| 4,062,283 | 12/1977 | Kaminski | 100/902 X |
| 4,213,384 | 7/1980 | Telling | 100/74 |
| 4,240,341 | 12/1980 | Whipple et al. | 100/49 |
| 4,296,683 | 10/1981 | Lidik et al. | 100/53 |
| 4,326,457 | 4/1982 | Sather | 100/902 |

*Primary Examiner*—Billy J. Wilhite

*Attorney, Agent, or Firm*—Hubbard, Thurman, Turner & Tucker

[57] ABSTRACT

A crusher for articles such as aluminum cans, having a crushing chamber with a bearing plate disposed in the base thereof. An ejection lever is disposed within the bottom of the crushing chamber and is utilized to actuate a crusher piston and eject the crushed article at the end of a cycle. In the embodiment disclosed, the placing of an article within the crushing chamber retracts the ejection lever against a spring or other mechanical bias element. This movement of the ejection lever then actuates a switch to operate the crusher piston. The downward operation of the crusher piston causes a latch to restrain the ejection lever in its retracted position. As the crusher piston reaches the maximum amount of travel, a limit switch reverses the drive mechanism and the crusher piston moves upward. When the crusher piston reaches its uppermost position it operates the latch restraining the ejection lever and the ejection lever is mechanically biased toward its original position, ejecting the contents of the crushing chamber and deactivating the crusher piston.

5 Claims, 4 Drawing Figures

CAN CRUSHER

BACKGROUND OF THE INVENTION

This invention relates to can crushers in general and in particular to can crushers which are activated by the placing of a can within the can crusher and which eject the crushed can at the end of the cycle.

Many commercial and household can crushers are known in the prior art. Each of these can crushers has been developed as a result of the recent emphasis on energy and resource conservation which has brought about a need for devices which can compact various containers and objects to minimize the problems of storage and disposal. The number and size of the various containers which accumulate, either commercially or in a household, necessitates that the compacted storage approach be utilized. The various devices and methods utilized to compact these containers have, on the whole, been bulky, cumbersome objects which require large amounts of space and energy to utilize.

Recently, manufacturers of such devices have been recognizing the need for a simple, easily operated, residential compactor which could be utilized to compact the ubiquitous aluminum can. These prior art devices typically include a closed crushing chamber which must be opened to inspect or remove the crushed object, or a bottomless crushing chamber which permits the crushed object to fall out due to the force of gravity.

Each of these approaches has certain problems inherent therein. The closed crushing chamber must be opened each cycle to permit the removal of a crushed can and the introduction of a second can. This is both time consuming and dangerous if the consumer fails to close the chamber properly. The gravity chute methods work well except in those instances in which the crushed can has not been sufficiently crushed to fit through the chute or in which the chute becomes obstructed in some manner.

SUMMARY OF THE INVENTION

Accordingly, it is therefore one object of the present invention to provide an improved can crusher.

It is another object of the present invention to provide an improved can crusher which operates automatically upon the placing of a can within its crushing chamber.

It is yet another object of the present invention to provide an improved can crusher which automatically and positively ejects the contents of the crushing chamber after each cycle of the can crusher.

It is another object of the present invention to provide an improved can crusher which may be simply and inexpensively constructed of readily available materials.

The foregoing objects are achieved as is now described. The can crusher of the present invention has a crushing chamber with a bearing plate disposed in the base thereof. An ejection lever is disposed within the bottom of the crushing chamber and is utilized to actuate a crusher piston and eject the crushed article at the end of a cycle. In the embodiment disclosed, the placing of an article within the crushing chamber retracts the ejection lever against a spring or other mechanical bias element. This movement of the ejection lever then actuates a switch to operate the crusher piston. The downward operation of the crusher piston causes a latch to restrain the ejection lever in its retracted position. As the crusher piston reaches the maximum amount of travel, a limit switch reverses the drive mechanism and the crusher piston moves upward. When the crusher piston reaches its uppermost position it operates the latch restraining the ejection lever and the ejection lever is mechanically biased toward its original position, ejecting the contents of the crushing chamber and deactivating the crusher piston.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
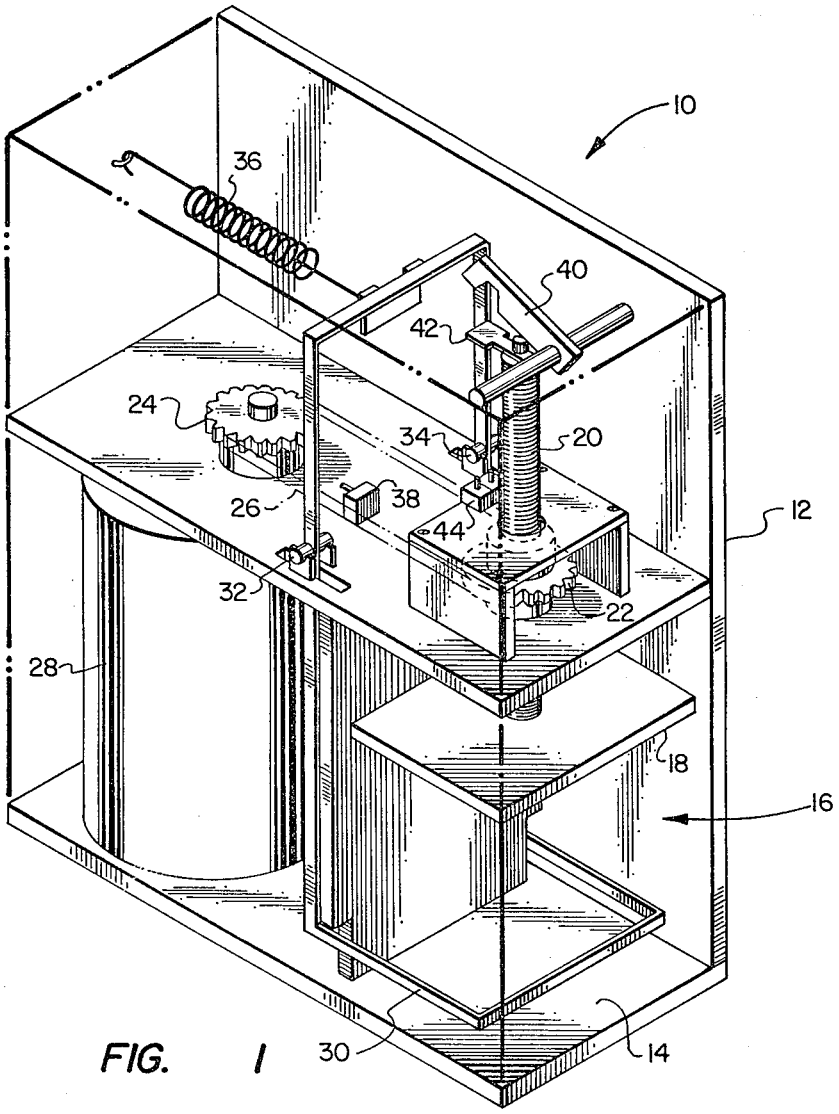
FIG. 1 depicts a partially cutaway perspective view of the novel can crusher of the present invention.

With reference now to the figures and in particular with reference to FIG. 1, there is depicted a partially cutaway perspective view of the novel can crusher of the present invention. Can crusher 10 includes a housing 12, which may be constructed of metallic or plastic materials, and which preferably includes a portion thereof which is constructed of transparent plastic to permit the operator to observe the mechanisms within. Housing 12 also includes a bearing plate 14 disposed horizontally within crushing chamber 16.

A crusher piston 18 is arranged for reciprocal movement within crushing chamber 16 and is utilized to crush aluminum cans disposed within crushing chamber 16. Crusher piston 18 is mounted to threaded rod 20 which is driven by means of sprockets 22 and 24, chain 26 and electric motor 28. Those ordinarily skilled in the art will appreciate that alternate methods of operating crusher piston 18, such as hydraulic or pneumatic systems, may be utilized. Also depicted in FIG. 1 is ejection lever 30. Ejection lever 30 is preferably pivotally mounted at points 32 and 34 in any manner well known in the art and is mechanically biased into ejection chamber 16 by means of spring 36.

Figure 2:
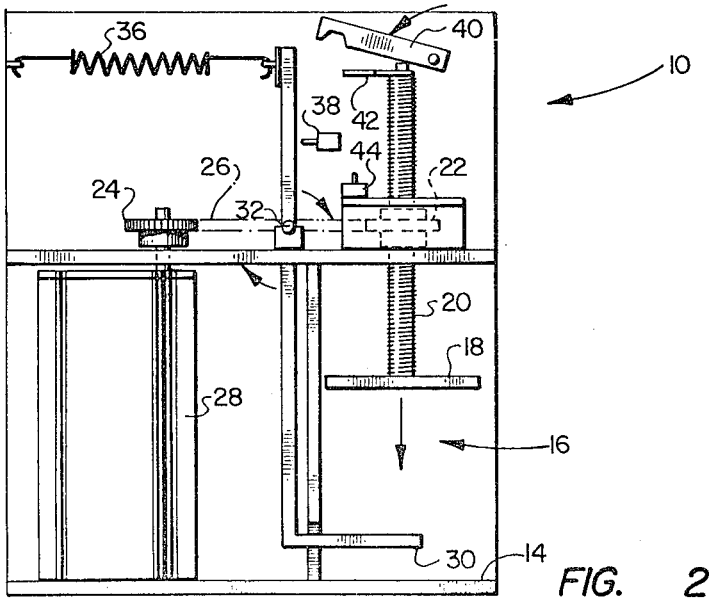
FIG. 2 depicts a cutaway side view of the novel can crusher of the present invention prior to operation.
Figure 3:
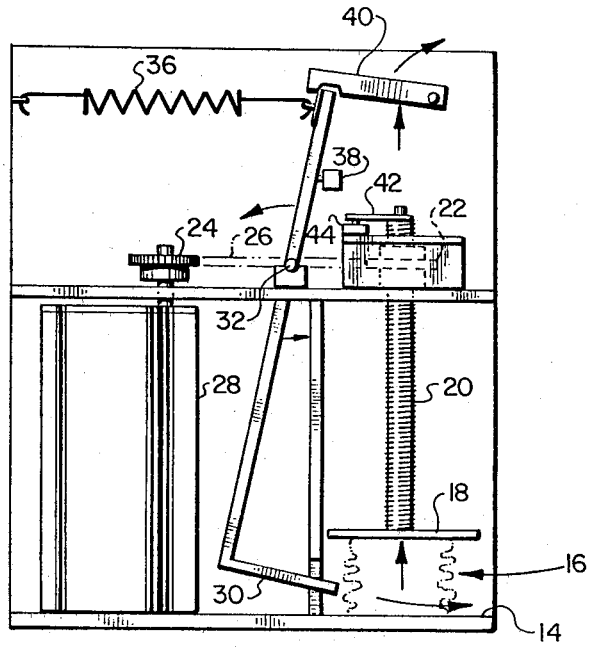
FIG. 3 depicts a cutaway side view of the novel can crusher of the present invention during a typical operation cycle.

The operation of can crusher 10, and in particular the operation of ejection lever 30, can best be illustrated upon reference to FIGS. 2 and 3 which illustrate cutaway side views of can crusher 10 prior to operation and during operation. In FIG. 2, it can be seen that the introduction of an aluminum can into crushing chamber 16 will pivot ejection lever 30 about points 32 and 34 (not shown) into the position depicted in FIG. 3. As ejection lever 30 pivots, switch 38 is activated by a portion of ejection lever 30 and energizes motor 28 causing sprocket 22 to be driven. The internal threads of sprocket 22 engage the threads on threaded rod 20 and crusher piston 18 is driven downward into crushing chamber 16. As the uppermost portion of threaded rod 20 moves downward, latch 40 will pivot downward under the force of gravity and engage the upper portion of ejection lever 30, latching ejection lever 30 into the position depicted in FIG. 3 and overcoming the bias provided by spring 36.

As crusher piston 18 reaches its most downward position, lever 42 engages switch 44 and reverses the direction of motor 28, causing crusher piston 18 to begin rising within crushing chamber 16. Those skilled in the art will appreciate that when threaded rod 20 reaches a sufficiently upward position it will intersect lever 40, raising lever 40 and releasing ejection lever 30 to respond to the bias of spring 36, ejecting the crushed contents of crushing chamber 16.

Figure 4:
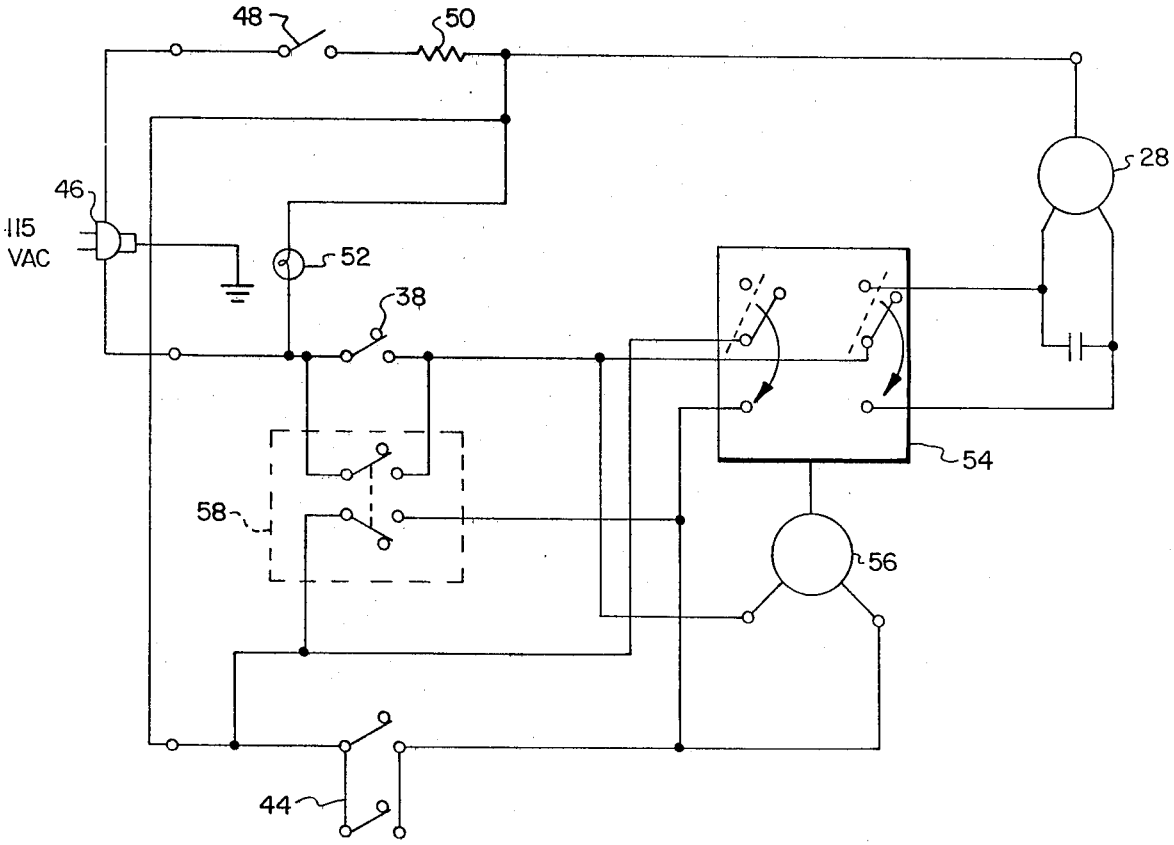
FIG. 4 is an electrical schematic of one embodiment of the novel can crusher of the present invention.

Referring now to FIG. 4, there is depicted an electrical schematic of one embodiment of the novel can crusher of the present invention. Electrical power is provided by means of plug 46 from any convenient household source. Main power switch 48 and fuse 50 provide a means of applying and controlling electrical power and indicator lamp 52 provides an indication that electrical power has been applied.

Those skilled in the art will appreciate that motor 28 may be wired in many alternate circuits and is depicted in the aforementioned figure in one such circuit in which a relay 54 controlled by a holding coil 56 is utilized to control the application and direction of electrical power to motor 28. Switch 38 initially applies power to motor 28 in order to drive crusher piston 18 (not shown) in the downward direction. Switch 44 (a double switch for safety reasons in the depicted embodiment) has been utilized to reverse the rotation of motor 28 to raise crusher piston 18. Additionally, an override manual switch 58 is provided to permit the operator to control the operation of crusher piston 18 with a greater degree of security.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A can crusher comprising:

a housing having a crushing chamber with a can receiving opening disposed therein;

a bearing plate disposed within said crushing chamber;

a crusher means arranged for reciprocating movement in said crushing chamber, said crusher means movable between a first position distant from said bearing plate and a second position proximate to said bearing plate;

an ejection lever disposed within said housing and movable between a first position and a second position;

bias means for urging said ejection lever towards its first postion;

means for causing said crusher means to move from said first position to said second position in response to said ejection lever moving from its first position to its second postion; and latch means for retaining said ejection lever in its second position in response to said crusher means moving from its first position and for suddenly releasing said ejection lever from its second position in response to said crusher means returning to its first position wherein said ejection lever rapidly returns to its first position in response to the urging of said bias means.

2. The can crusher according to claim 1; wherein said bearing plate is disposed horizontally within said housing.

3. The can crusher according to claim 1 further including an electric motor for driving said crusher means.

4. The can crusher according to claim 1 wherein said crusher means comprises a threaded rod and a crusher plate mounted to said threaded rod and includes a rotatable sprocket threaded to said threaded rod for raising and lowering said crusher plate.

5. The can crusher according to claim 3 further including means for reversing the operation of said electric motor in response to said crusher means moving to said second position.

* * * * *